US010245570B2

(12) United States Patent
Wei et al.

(10) Patent No.: US 10,245,570 B2
(45) Date of Patent: Apr. 2, 2019

(54) MULTI-CHANNEL MAGNETIC CONTROL SYSTEM

(71) Applicant: NATIONAL TSING HUA UNIVERSITY, Hsinchu (TW)

(72) Inventors: Zung-Hang Wei, Hsinchu (TW); Jen-Hwa Hsu, Taipei (TW); Ching-Ray Chang, Taipei (TW); Hao-Ting Huang, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 547 days.

(21) Appl. No.: 15/009,143

(22) Filed: Jan. 28, 2016

(65) Prior Publication Data

US 2017/0080435 A1 Mar. 23, 2017

(30) Foreign Application Priority Data

Sep. 21, 2015 (TW) ..... 104131189 A

(51) Int. Cl.

| | |
|---|---|
| ***B01F 13/08*** | (2006.01) |
| ***B01L 3/00*** | (2006.01) |
| ***B03C 1/24*** | (2006.01) |
| ***B03C 1/28*** | (2006.01) |

(52) U.S. Cl.

CPC ..... *B01F 13/0809* (2013.01); *B01L 3/5027* (2013.01); *B03C 1/24* (2013.01); *B03C 1/288* (2013.01)

(58) Field of Classification Search

CPC ..... B01F 13/809; B01F 13/0809; B03C 1/24; B03C 1/288

See application file for complete search history.

(56) References Cited

U.S. PATENT DOCUMENTS

2012/0222940 A1* 9/2012 Ehresnnann ..... B03C 1/02 198/617

2014/0342470 A1* 11/2014 Su ..... G01N 1/4044 436/501

* cited by examiner

*Primary Examiner* — David A Reifsnyder

(74) *Attorney, Agent, or Firm* — Muncy, Geissler, Olds & Lowe, P.C.

(57) ABSTRACT

A multi-channel magnetic control system is provided, which is used for mixing fluids containing magnetic particles or separating magnetic species. In the multi-channel magnetic control system, a plurality of magnetic field switches are allocated to surround a plurality of channels, and the magnetization directions of the magnetic field switches are controlled to generate an uneven local magnetic field gradient, so as to achieve the purpose of fluid mixing or separating the magnetic species. This system can be also used as controllable flow resistance devices for magnetic fluids. Based on the demand of magnetic field distribution, overall or local control of the magnetic field switches can be executed to perform parallel processing over the multi-channel system of multi-dimensional allocation, so as to effectively save the processing time. The mixing or separation rate can be obtained via detecting residual magnetic species by magnetoresistive sensors arranged in inlets and outlets of channels.

7 Claims, 7 Drawing Sheets

MULTI-CHANNEL MAGNETIC CONTROL SYSTEM

CROSS-REFERENCE TO RELATED APPLICATION

This application claims the benefit of Taiwan Patent Application No. 104131189, filed on Sep. 21, 2015, in the Taiwan Intellectual Property Office, the disclosure of which is incorporated herein in its entirety by reference.

BACKGROUND OF THE INVENTION

1. Field of the Invention

The present disclosure generally relates to a multi-channel magnetic control system which applies a plurality of magnetic elements consisted of magnetic elements having different magnetic anisotropies to control the magnetic cluster of the channel system, and the disclosed multi-channel magnetic control system is capable of magnetizing the magnetic species in the channel to interfere the magnetic field, so as to mix the magnetic fluids or to separate the magnetic species from the fluids.

2. Description of the Related Art

With the rapid development of the biochip and the biomedical microsystem, mixing fluids and separating species in the channel have become a hot spot in the research. As far as the continuously flowing fluids are concerned, the fluid mix and species separation can be divided into active and passive types. The active type, which is to apply electricity or magnetization to the fluids or species, is more flexible and therefore popularized. In addition, as the magnetic fluids and particles have been applying to the biochip nowadays, research to achieve more effectiveness on the use of magnetic species to mix or collect magnetically targeted species have been focused.

The conventional technique is to use an electromagnet as a magnetic field switch to mix fluids or to separate species. Although it is easy to adjust the magnetic field intensity, the electromagnet also generates heat along with the magnetic field, such that the temperature is changed and the characteristic of the fluids or species is also affected due to the temperature variation. Moreover, using the electromagnet as the magnetic field switch needs to continuously supply current. In addition, it is hard to manufacture the micro-coil by the existing micro-nano manufacturing technology. Therefore, alternatives of the magnetic field switch have to be taken into account.

As a result, the inventor of the present disclosure has been mulling the technical problems over and then designs a multi-channel magnetic control system aims at improving the current shortcomings so as to promote the industrial practicality.

SUMMARY OF THE INVENTION

In view of the aforementioned technical problems, one objective of the present disclosure provides a multi-channel magnetic control system which switches the magnetic field switch by controlling the magnetization direction of the magnetic element. When the magnetic element is turned on, the magnetic fluids or species in the channel are magnetized to change the fluid direction, such that the purpose of mixing fluids or separating species is achieved. Besides, the magnetic element can be turned off when it is not in use.

In view of the aforementioned technical problems, another objective of the present disclosure provides a multi-channel magnetic control system, wherein the magnetic field switch of the multi-channel magnetic control system is consisted of magnetic element. After being magnetized, the magnetic element maintains the pure magnetic moment without the continuous apply of an external electric field, and therefore the continuous supply of current becomes unnecessary. Consequently, the magnetic field can be generated without continuously supplying current so that the thermal effect is therefore avoided and electricity consumption becomes dispensable.

In view of the aforementioned technical problems, yet another objective of the present disclosure applies the channel to arrange in a multi-dimensional arrangement and arranges a plurality of magnetic field switches to simultaneously mix fluids and/or separate magnetic species, so as to effectively save the processing time.

In accordance with the aforementioned objectives, the present disclosure provides a multi-channel magnetic control system including: a plurality of channels arranged in a two-dimensional model or a three-dimensional model; a plurality of magnetic field switches disposed between the plurality of channels, wherein at least one magnetic field switch may be shared by at least two channels, and each magnetic field switch may include a plurality of magnetic elements having respective switching magnetic fields; and a control module changing a magnetization direction of the magnetic elements of the at least one magnetic field switch according to a magnetic field distribution demand, so as to generate a local magnetic field gradient in the plurality of channels.

Preferably, the plurality of magnetic field switches allocated at two sides of at least one channel may be arranged in a corresponding arrangement, a staggering arrangement or a combination thereof.

Preferably, the plurality of magnetic field switches allocated at the same side of at least one channel may be arranged in a fixed distance respectively.

Preferably, the fixed distance may be between 0.1 μm and 2000 μm.

Preferably, the plurality of magnetic switches disposed between two channels which are adjacent to each other may be shared by the two channels.

Preferably, the control module may control a magnetization direction of the magnetic field switches intermittently to increase a mixing efficiency of mixing and/or separating fluids in the plurality of channels.

Preferably, the control module may control the magnetization direction of the magnetic field switches according to a demand of flow resistance.

Preferably, an inlet and an outlet of the channels may further be disposed with a magnetoresistive sensor respectively to sense a degree of mixing of a fluid or a residual rate of a magnetic species that is separated.

Preferably, the control module may control the plurality of magnetic field switches entirely or locally according to the magnetic field distribution demand.

Preferably, each switching magnetic field may be generated from same or different magnetic materials having different magnetic anisotropies.

Preferably, the magnetic element may be a stacked multilayer film, a plurality of separated films or a plurality of separated multilayer films.

Preferably, the plurality of magnetic elements may correspond to respective switching magnetic fields, and each switching magnetic field may be generated from same or different magnetic materials having different magnetic anisotropies.

Preferably, each magnetic anisotropy of the magnetic elements is generated from a shape anisotropy or a magnetocrystalline anisotropy.

The multi-channel magnetic control system of the present disclosure may have one or more advantages as follows.

1. Decrease of power consumption. Utilizing the characteristics of ferromagnetic materials, after obtaining the magnetic property from an external magnetic field, the magnetic material is still capable of maintaining the magnetic property even if the external magnetic field disappears. As a result, the magnetic field can be generated without continuously supplying current, so that the power consumption is decreased.

2. Prevention of the thermal effect. As continuously supplying electrical field is unnecessary for maintaining the magnetic field, the heat is therefore greatly decreased. Consequently, the multi-channel magnetic control system of the present disclosure can avoid the temperature variation and the thermal effect.

3. Simultaneous process. By means of the multi-dimensional arrangement and the arrangement of a plurality of magnetic field switches, mixing of fluids containing magnetic particles and/or separating magnetic species can be performed simultaneously to save the processing time.

4. Increase of efficiency. According to the magnetic field distribution demand, the magnetization direction of the magnetic field switches can be controlled entirely or locally to promote the mixing efficiency and/or separation efficiency of the fluids in the channel.

With these and other objects, advantages, and features of the invention that may become hereinafter apparent, the nature of the invention may be more clearly understood by reference to the detailed description of the invention, the embodiments and to the several drawings herein.

BRIEF DESCRIPTION OF THE DRAWINGS

For better understanding, like elements are designated by like reference numerals in the accompanying drawings and the following description for the embodiments.

DETAILED DESCRIPTION OF THE PREFERRED EMBODIMENTS

In order to facilitate the understanding of the technical features, the contents and the advantages of the present disclosure, and the effectiveness thereof that can be achieved, the present disclosure will be illustrated in detail below through embodiments with reference to the accompanying drawings. On the other hand, the diagrams used herein are merely intended to be schematic and auxiliary to the specification, but are not necessary to be true scale and precise configuration after implementing the present disclosure. Thus, it should not be interpreted in accordance with the scale and the configuration of the accompanying drawings to limit the scope of the present disclosure on the practical implementation.

Hereinafter, embodiments of the present disclosure will be described in detail with reference to the accompanying drawings so that those skilled in the art to which the present disclosure pertains can realize the present disclosure. As those skilled in the art would realize, the described embodiments may be modified in various different ways, all without departing from the spirit or scope of the present disclosure.

Figure 1:
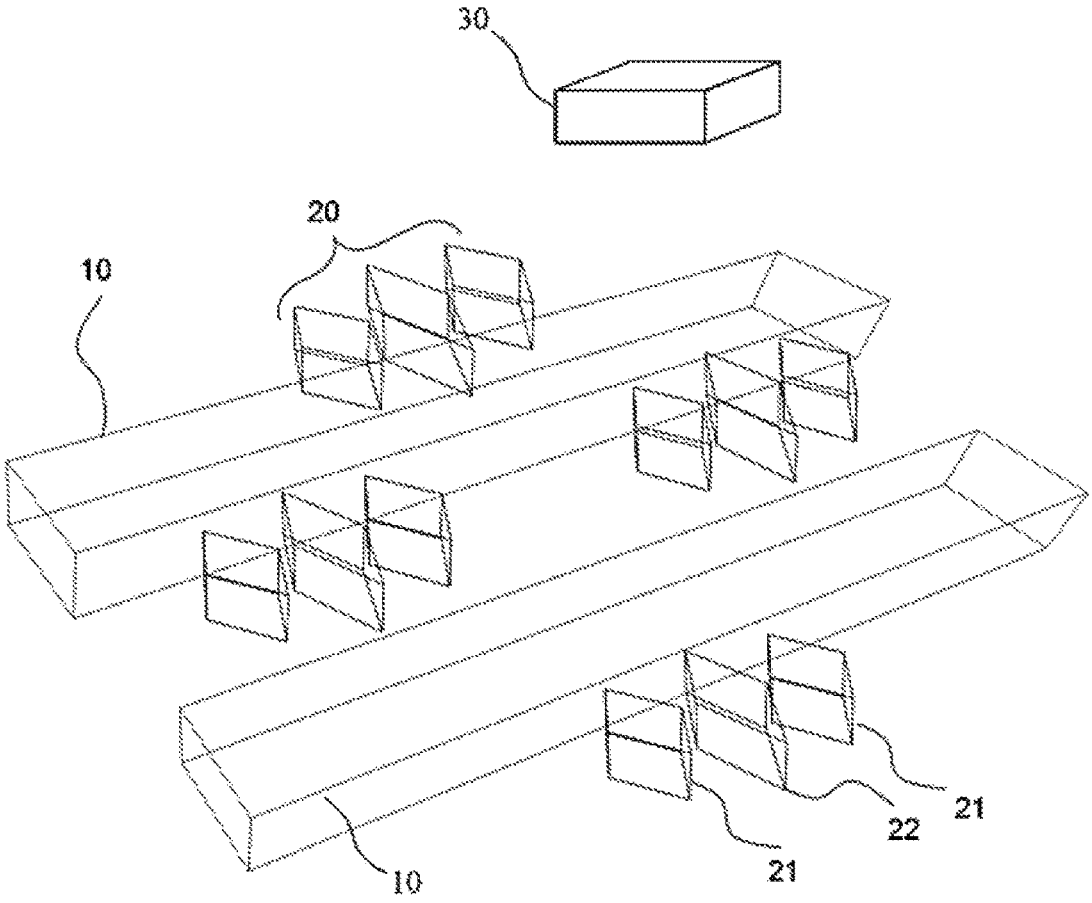
FIG. 1 is a schematic diagram illustrating the structure of the multi-channel magnetic control system of the present disclosure.

Please refer to FIG. 1 which is a schematic diagram illustrating the structure of the multi-channel magnetic control system of the present disclosure. As shown in the figure, a multi-channel magnetic control system of the present disclosure includes a plurality of channels 10, a plurality of magnetic field switches 20 and a control module 30. The plurality of channels 10 can be arranged in a two-dimensional model or a three-dimensional model according to the actual requirement or application. In practice, it can further extend in the space with an arbitrary direction.

The plurality of magnetic field switches 20 are respectively disposed between the plurality of channels 10, wherein at least one magnetic field switch 20 is shared by at least two channels 10. Each magnetic field switch 20 includes a plurality of magnetic elements characterized of respective magnetic anisotropies. The plurality of magnetic field switches 20 allocated at two sides of at least one channel 10 are arranged in a corresponding arrangement, a staggering arrangement, or a combination thereof.

For example, each magnetic field switch 20 includes two magnetic elements 21 having a smaller magnetic anisotropy and one magnetic element 22 having a larger magnetic anisotropy. The magnetic element is made of a magnetic material, and can be formed by a stacked multilayer film, a plurality of separated films, or a plurality of separated multilayer films. But it shall be not limited thereto.

The control module 30 changes a magnetization direction of the magnetic elements of at least one the magnetic field switch 20 according to a magnetic field distribution demand, so as to generate a local magnetic field gradient in the plurality of channels 10. The control module 30 controls the magnetization direction of the magnetic field switch 20 intermittently so as to increase the efficiency of mixing fluid containing magnetic particles and/or separating magnetic species in the plurality of channels 10.

Figure 2:
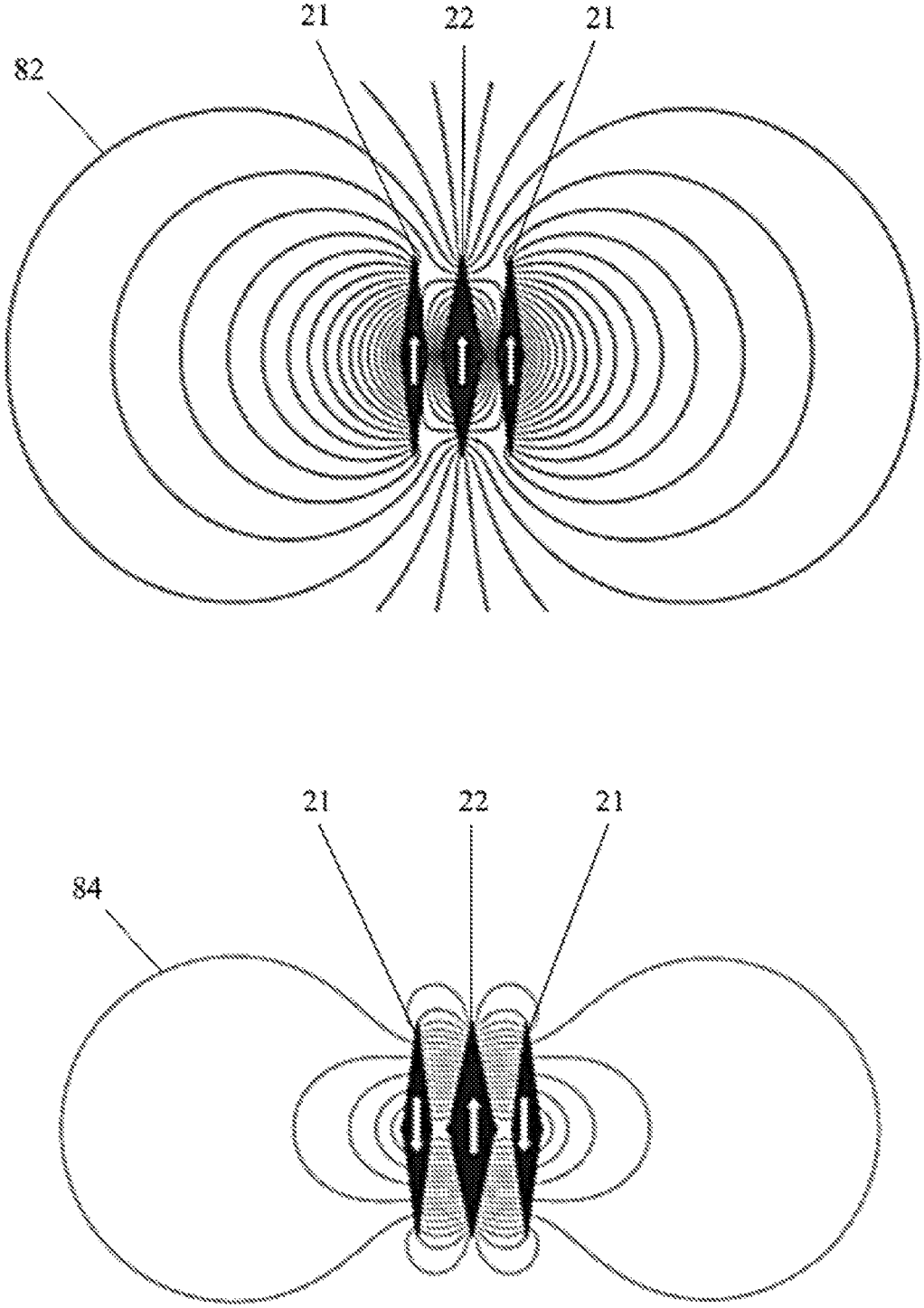
FIG. 2 is a schematic diagram illustrating the conception of the magnetic field switch of the multi-channel magnetic control system of the present disclosure.

Please refer to FIG. 2 which is a schematic diagram illustrating the conception of the magnetic field switch of the multi-channel magnetic control system of the present disclosure. As shown in the figure, the two magnetic elements 21 having the smaller magnetic anisotropy and the magnetic element 22 having the larger magnetic anisotropy are made of magnetic materials characterized of respective switching magnetic fields. The switching magnetic fields are generated from the same magnetic material characterized of different magnetic properties or anisotropies such as shape anisotropy, magnetocrystalline anisotropy, or from various magnetic materials, indicating that the two magnetic elements 21 having the smaller magnetic anisotropy and the magnetic element 22 having the larger magnetic anisotropy have respective switching magnetic fields for switching the magnetization direction.

When arranging the magnetic elements having different magnetic anisotropies, an external magnetic field with larger magnitude is added to magnetize all the magnetic elements to the same magnetization direction (the arrowheads of the magnetic elements), that is, the north and south magnetic poles of all the magnetic elements are magnetized to the same direction, such that these magnetic elements are combined to become a large magnet so as to form a strong magnetic cluster 82, and then the magnetic field switch 20 is defined as "ON".

Similarly, when an external magnetic field which has a magnetization direction opposing to an initial magnetization direction of a magnetic element is added and the external magnetic field can only enable the two magnetic elements 21 having the smaller magnetic anisotropy to generate the magnetization switching, therefore the magnetic poles of the two magnetic elements 21 having the smaller magnetic anisotropy will have a reverse direction to the magnetic pole of the magnetic element 22 having the larger magnetic anisotropy. As a result, the magnetic field of the two magnetic elements 21 having the smaller magnetic anisotropy inters the end point of the magnetic element 22 having the larger magnetic anisotropy to form a weak magnetic cluster 84. The aspect is applied to define the magnetic field switch 20 to be "OFF".

Figure 3:
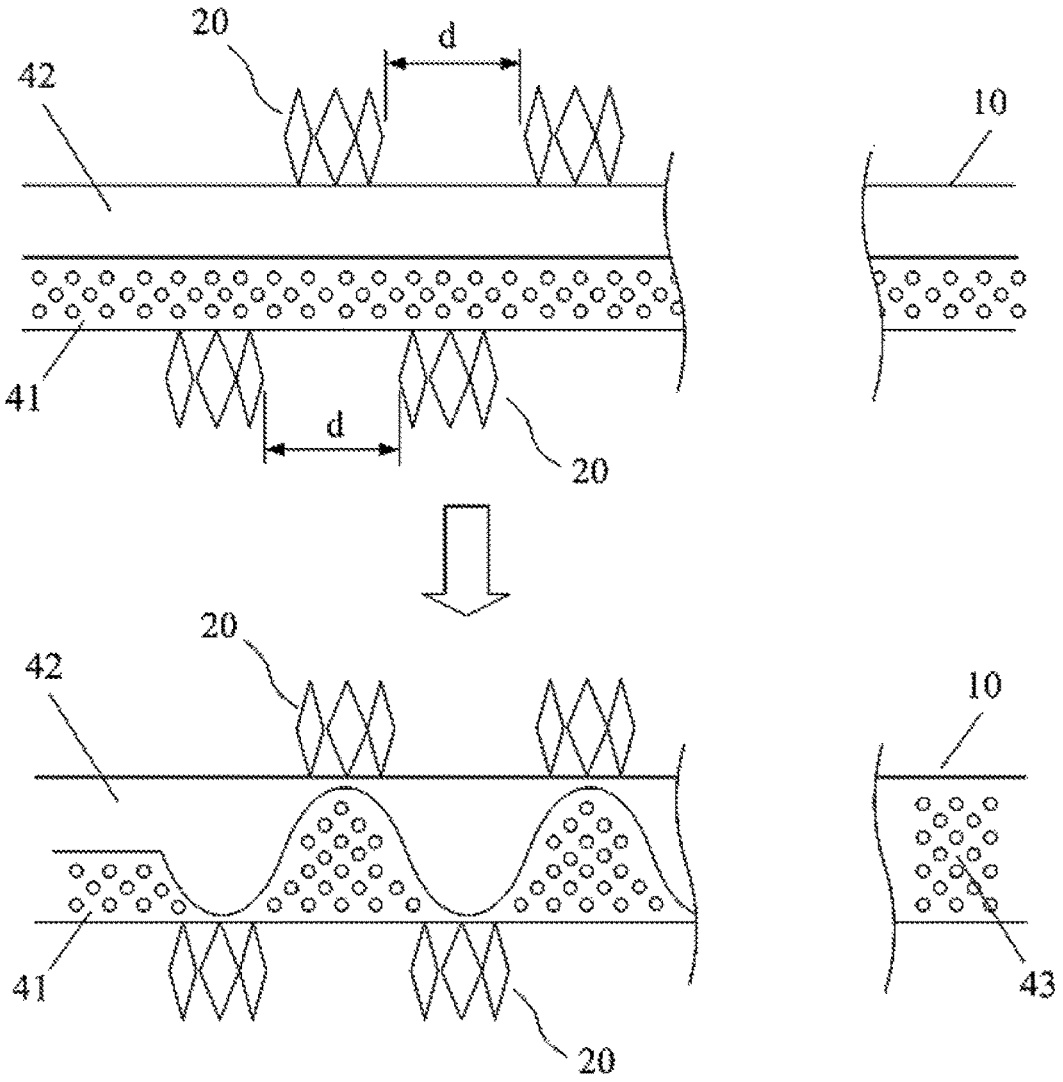
FIG. 3 is a schematic diagram illustrating the fluid mix of the multi-channel magnetic control system of the present disclosure.
Figure 4:
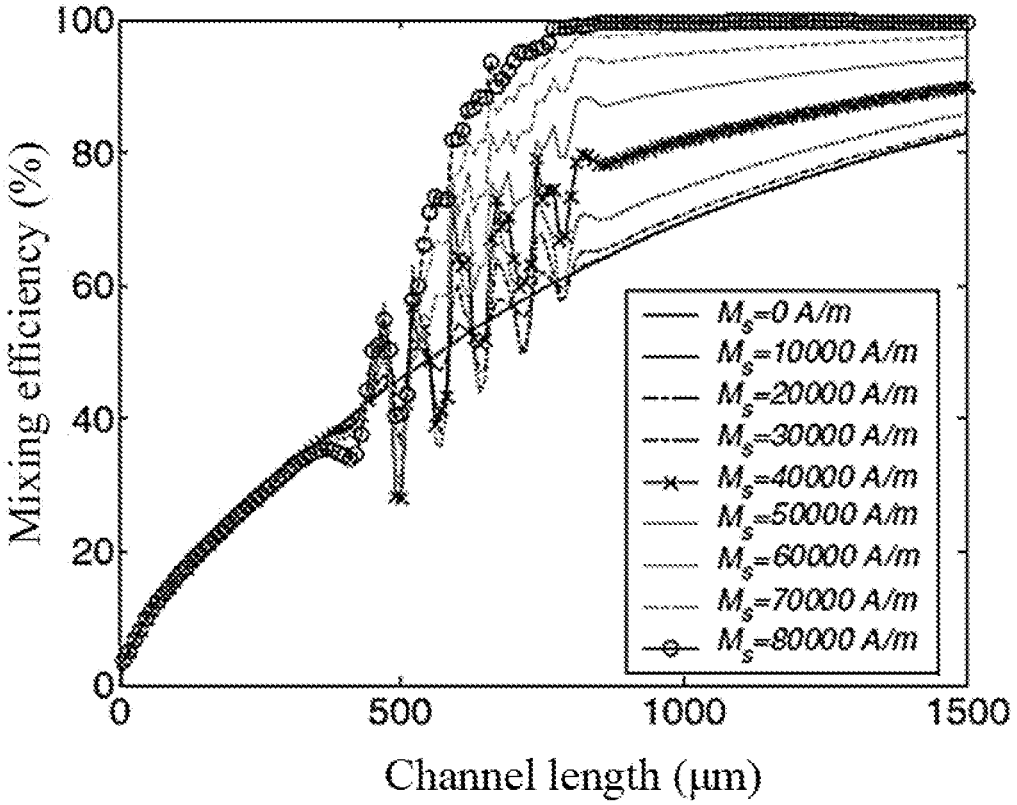
FIG. 4 is a diagram showing the experiment result of fluid mix of the multi-channel magnetic control system of the present disclosure.

Please refer to FIG. 3 and FIG. 4 together. As shown in the figures, in the multi-channel magnetic control system of the present disclosure, the magnetic field switches 20 allocated at one side of at least one channel 10 is arranged in a fixed distance d, and the magnetic field switches 20 allocated at opposing sides of the at least one channel 10 is allocated with a staggering arrangement. The fixed distance d is between 0.1 μm and 2000 μm. In practice, when the magnetic element of the magnetic field switch 20 is a stacked multilayer film, the gap between each fixed distance is smaller than 0.1 μm.

Firstly, a magnetic fluid 41 and a non-magnetic fluid 42 are introduced into the channel 10. If the magnetic field switches 20 allocated at two sides of the channel 10 are not turned on, the magnetic fluid 41 and the non-magnetic fluid 42 will only be slightly mixed after flowing a long distance.

When mixing the fluids, the plurality of magnetic field switches 20 are turned on, and the strong magnetic cluster 82 of the plurality of magnetic field switches 20 affects the magnetic fluid 41 magnetically to draw the magnetic fluid 41 towards the plurality of magnetic field switches 20 while ruling out the non-magnetic fluid 42, enabling the flow path of the fluids to have a curve trend so as to increase the contact length and the contact time between the fluids and to cause a chaotic flow field to mix the fluids. As a result, it can enhance the mixing efficiency of the magnetic fluid 41 and the non-magnetic fluid 42, such that when the magnetic fluid 41 and the non-magnetic fluid 42 flow through the plurality of magnetic field switches 20, they are mixed to become an even fluid 43.

FIG. 4 also illustrates that the mixing efficiency varies with the variation of the magnetic cluster intensity of the plurality of magnetic field switches 20. The plurality of magnetic field switches 20 are allocated in a distance starting from an inlet of the channel 10 to 500 μm. When a conducted magnetic field intensity is over 30000 A/m, the mixing efficiency is over 84% in 1500 μm of the channel 10. The experiment result also shows that the stronger the magnetic field intensity is, the better the mixing efficiency will become. Therefore, the experiment results verify that the multi-channel magnetic control system of the present disclosure does promote the mixing efficiency of the even fluid 43.

Figure 5:
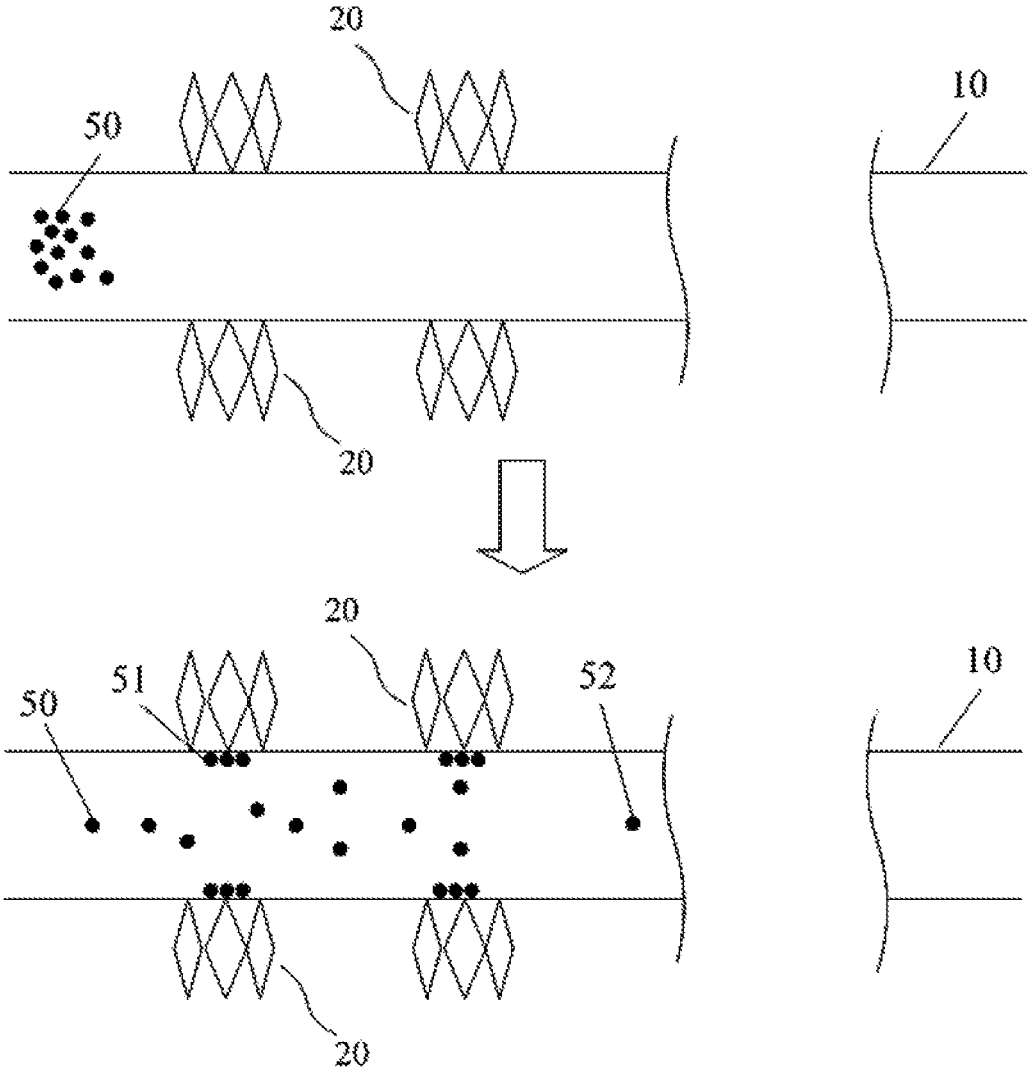
FIG. 5 is a schematic diagram illustrating the species separation of the multi-channel magnetic control system of the present disclosure.

Please refer to FIG. 5 which is a schematic diagram illustrating the magnetic species 50 separation of the multi-channel magnetic control system of the present disclosure. The plurality of magnetic field switches 20 are allocated at two sides of the channel 10 correspondingly. Besides, the magnetic field switches 20 allocated at the same side is still arranged in the fixed distance d.

As shown in the figure, the fluid containing the magnetic species 50 is introduced into the channel 10. If the plurality of magnetic field switches 20 allocated at two sides of the channel 10 are not turned on, the fluid is not affected. When the plurality of magnetic field switches 20 allocated at two sides of the channel 10 are turned on, the strong magnetic cluster 82 of the plurality of magnetic field switches 20 draws the magnetic species 50 from the channel 10 towards the plurality of magnetic field switches 20. The amount of drawn magnetic species 51 which adhere to the periphery of the wall of the channel 10 is obviously greater than the amount of other magnetic species 52 which keep flowing through the channel 10. This proves that the plurality of magnetic field switches 20 can effectively draw and capture most magnetic species 50.

When the plurality of magnetic field switches 20 are "OFF", the weak magnetic cluster 84 releases the magnetic species 51 back to the channel 10 and the magnetic species 50 can be collected in the outlet of the channel 10, such that the purpose of separating the magnetic species 50 is achieved.

Figure 6:
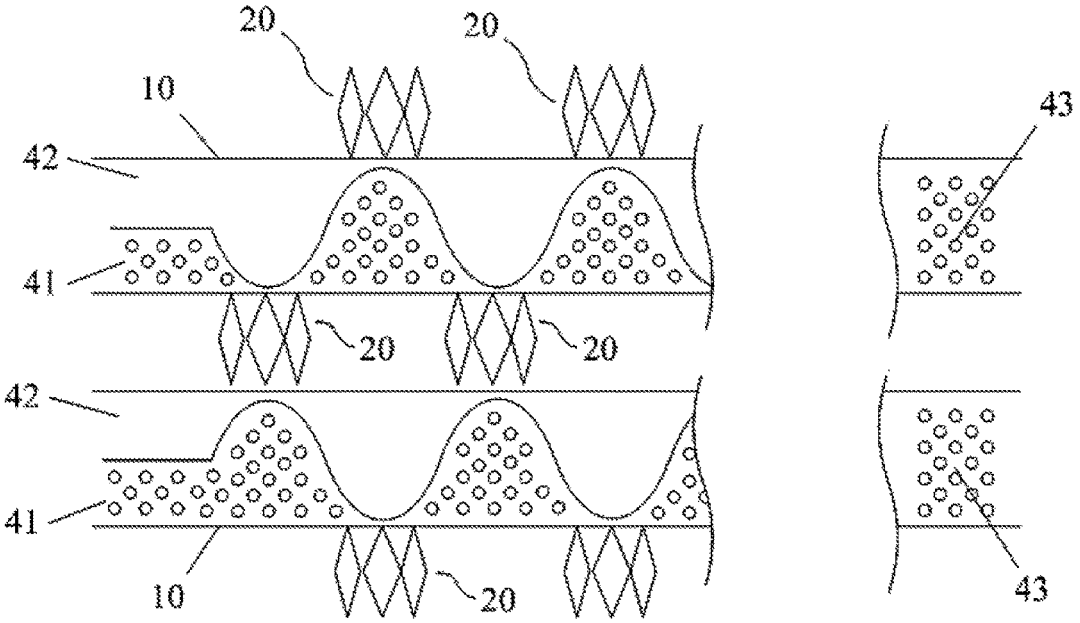
FIG. 6 is a schematic diagram illustrating the configuration of two adjacent channels, which are both performing fluid mix, of the multi-channel magnetic control system of the present disclosure.

Please refer to FIG. 6. As shown in the figure, the present embodiment shows an example when two channels 10 are parallel to each other, and the plurality of magnetic field switches 20 between the two adjacent channels 10 are being shared by the two channels 10. The control module 30 is applied to adjust the plurality of magnetic field switches 20 entirely or locally according to the magnetic field distribution demand.

When the two adjacent channels 10 are performing fluid mix simultaneously, the plurality of magnetic field switches 20 are allocated with a staggering arrangement outside the periphery of the channels 10. As the magnetic cluster of the plurality of magnetic field switches 20 is surrounding in a cubical space, it can magnetically affect the two channels 10 simultaneously. When the plurality of magnetic field switches 20 are "ON", the mixing efficiencies of both the magnetic fluid 41 and the non-magnetic fluid 42 are increased in the two channels 10. Compared with single channel 10, the two channels 10 are capable of processing a double fluid volume. In addition, as the plurality of magnetic field switches 20 can be shared, the cost is therefore decreased.

Figure 7:
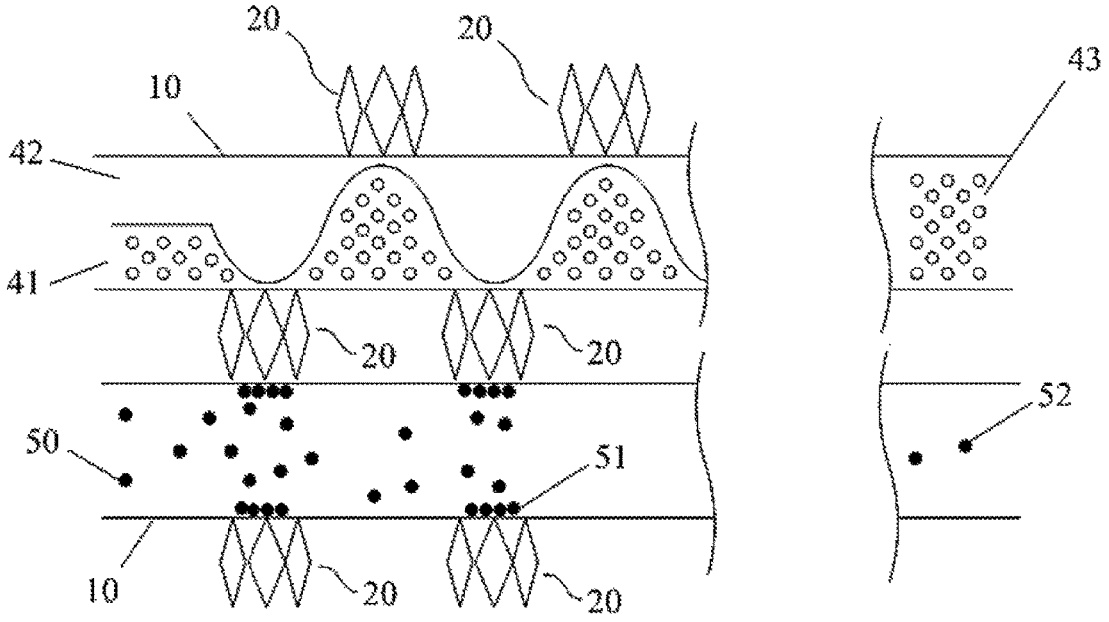
FIG. 7 is a schematic diagram illustrating the configuration of two adjacent channels, which are both performing fluid mix and species separation simultaneously, of the multi-channel magnetic control system of the present disclosure.

Please refer to FIG. 7. The arrangement of the magnetic field switches 20 is similar to FIG. 6. The difference between FIG. 7 and FIG. 6 lies that the plurality of magnetic field switches 20 allocated on an upper channel 10 and at a lower channel 10 have different allocations.

If the fluid mix and species separation are performed in the channel system, the plurality of magnetic field switches 20 allocated on the upper channel 10 have the staggering arrangement, and the upper channel 10 is served for mixing the flow. The plurality of magnetic field switches 20 allocated at the lower channel 10 are a corresponding arrangement and the lower channel 10 is applied to separate the magnetic species 50.

The plurality of magnetic field switches 20 allocated at two sides of the channel 10 can have various arrangements, so that it is capable of producing different effects of mixing fluid and separating species. In addition, the control module 30 adjusts the plurality of magnetic field switches 20 entirely or locally according to the magnetic field distribution demand to generate different local magnetic field gradients having different intensities. To be more precise, when the local magnetic field gradient is generated, separating the magnetic species 50 according to the magnetic moment of the magnetic species 50 can be achieved so as to sieve the magnetic species 50.

The magnetic field switch of the present disclosure is consisted of a plurality of magnetic elements having respective magnetic anisotropies. The magnetic anisotropy characteristics of the magnetic element enable the magnetic element to be magnetized in a short period of time by the external magnetic field, and the magnetization and the pole strength of the magnetic element can be maintained for a long while without continuously supplying energy. The magnetic field switch of the present disclosure is therefore capable of decreasing the power consumption and the temperature variation compared to the conventional electromagnet which is continuously energized.

By means of the magnetic control system, the present disclosure is capable of entirely or locally control the parameters such as the operation frequency and the magnetic field intensity according to the actual magnetic field distribution demand, so as to generate local magnetic field gradients having different intensities. In addition, based on the flow resistance demand, the system can be also used as controllable flow resistance device for magnetic fluids.

By means of the multi-dimensional arrangement and the arrangement of a plurality of magnetic field switches, the present disclosure is capable of simultaneously mixing and/or separating fluid to effectively save the processing time. Besides, the inlet and outlet of the channel of the present disclosure are further disposed with a magnetoresistive sensor respectively to sense a degree of mixing of a fluid or a residual rate of a magnetic species that is separated.

While the means of specific embodiments in present disclosure has been described by reference drawings, numerous modifications and variations could be made thereto by those skilled in the art without departing from the scope and spirit of the invention set forth in the claims. The modifications and variations should in a range limited by the specification of the present disclosure.

What is claimed is:

1. A multi-channel magnetic control system, comprising:

a plurality of channels;

a plurality of magnetic field switches disposed around each of the plurality of channels, and each magnetic field switch comprises a plurality of magnetic elements having different magnetic anisotropies; and a control module providing an external magnetic field to change a magnetization direction of the magnetic elements of the at least one magnetic field switch, so as to generate a local magnetic field gradient in the plurality of channels.

2. The multi-channel magnetic control system of claim 1, wherein when the plurality of magnetic field switches allocated at two sides of each of the plurality of channels, the magnetic field switches allocated at one side of the channel and the magnetic field switches allocated at the other side of the channel are symmetrical to each other, or the magnetic field switches allocated at one side of the channel are between the magnetic field switches allocated at the other side of the channel.

3. The multi-channel magnetic control system of claim 2, wherein the magnetic field switches allocated at the same side of the channel are arranged in a fixed distance from each other.

4. The multi-channel magnetic control system of claim 3, wherein the fixed distance is between 0.1 μm and 2000 μm.

5. The multi-channel magnetic control system of claim 1, wherein the control module controls a magnetization direction of the magnetic field switches intermittently.

6. The multi-channel magnetic control system of claim 1, wherein the control module controls the plurality of magnetic field switches entirely or locally.

7. The multi-channel magnetic control system of claim 1, wherein each magnetic anisotropy of the magnetic elements is generated from a shape anisotropy or a magnetocrystalline anisotropy.

* * * * *